US005135012A

United States Patent [19]

Kamen et al.

[11] Patent Number: 5,135,012

[45] Date of Patent: Aug. 4, 1992

[54] MAGNETIC COMPACT CASE

[75] Inventors: Melvin Kamen, Highlands, N.J.; Philip Bernstein, Yardley, Pa.

[73] Assignee: Revlon, Inc., New York, N.Y.

[21] Appl. No.: 682,797

[22] Filed: Apr. 9, 1991

Related U.S. Application Data

[63] Continuation-in-part of Ser. No. 237,856, Aug. 29, 1988, abandoned.

[51] Int. Cl.[5] ..... A45D 33/26

[52] U.S. Cl. ..... 132/294; 132/301; 132/316; 206/818; 206/823; 220/230

[58] Field of Search ..... 132/286, 293, 294, 295, 132/297, 300, 301, 304, 305, 312, 315, 316; 206/818, 581, 823; 40/600; 220/230

[56] References Cited

U.S. PATENT DOCUMENTS

| | | | |
|---|---|---|---|
| 599,775 | 3/1898 | Fick | 132/293 |
| 1,682,534 | 12/1927 | Martinat . | |
| 2,288,688 | 7/1942 | Dubilier | 206/818 |
| 2,784,757 | 3/1957 | Bosca et al. | 206/581 |
| 2,825,447 | 3/1958 | Kurland | 206/818 |
| 3,317,078 | 7/1965 | Gordon . | |
| 3,716,091 | 2/1973 | Gaines | 206/818 |
| 3,727,658 | 4/1973 | Eldridge, Jr. | 206/818 |
| 4,018,237 | 4/1977 | Steiman | 132/304 |
| 4,045,291 | 8/1977 | Berger | 206/818 |
| 4,388,935 | 6/1983 | Napolitane | 132/294 |
| 4,454,889 | 6/1984 | Contreras . | |
| 4,569,438 | 2/1986 | Sheffler . | |
| 4,684,017 | 8/1987 | Watanabe . | |
| 4,738,390 | 4/1988 | Brennan | 206/818 |
| 4,815,608 | 3/1989 | Silberberg | 206/581 |
| 4,823,943 | 4/1989 | Chang | 206/818 |
| 4,836,387 | 6/1989 | Lephardt | 206/818 |

FOREIGN PATENT DOCUMENTS

| | | | |
|---|---|---|---|
| 0081901 | 6/1983 | European Pat. Off. | 132/294 |
| 2064615 | 12/1971 | Fed. Rep. of Germany | 220/230 |
| 743967 | 4/1933 | France | 220/230 |
| 0167055 | 6/1989 | Japan | 220/230 |

*Primary Examiner*—John J. Wilson
*Assistant Examiner*—Frank A. LaViola
*Attorney, Agent, or Firm*—Julie Blackburn

[57] ABSTRACT

A compact case has a lid which forms a joint with an associated base when the lid is in its closed position relative to the base. A magnetic sealing mechanism positively seals substantially the entire length of the joint. The magnetic sealing mechanism can also function to releasably and moveably secure cosmetic product containers and cosmetic implements and accessories to the compact case.

3 Claims, 3 Drawing Sheets

MAGNETIC COMPACT CASE

This application is a continuation-in-part of copending application Ser. No. 07/237,856, filed Aug. 29, 1988, now abandoned.

FIELD OF THE INVENTION

The present invention relates to compact cases, and, more particularly, to such cases employing movable or pivotable lids which form a joint with their associated bases.

BACKGROUND OF THE INVENTION

Compact cases and the like have been in existence for many years. Traditionally, such cases have employed a lid or cover which is pivotally attached by a hinge or an equivalent mechanical mechanism to a base or body of the case in such a manner that the lid can be pivoted relative to the base between a closed position and an open position. The use of a hinge is disadvantageous because it sets a practical limit on how thin the compact case can be due to the fact that the manufacture of a thin compact case would require the use of a miniature hinge whose manufacture would be complicated as a result of such miniaturization. Due to the complexity of molding a hinge, especially if it is miniaturized, high stresses develop in the plastic, creating the possibility that the body of the hinge might fracture. Such stresses also make the plastic susceptible to chemical attack and swelling, which, if severe enough, could render the hinge inoperable due to jamming.

In spite of the foregoing problems and disadvantages, there has been a trend to produce thinner and thinner compact cases in an effort to benefit from the numerous potential advantages which such compact cases offer. For instance, from a manufacturer's standpoint, the resulting reduction in the amount of material required to make a thin compact case could considerably lower manufacturing costs, while the resulting reduction in the physical size of a thin compact case could also lower shipping costs. From a user's standpoint, the resulting reduction in the physical size of the compact case would make it easier to carry and less conspicuous to use.

Typically, existing compact cases, regardless of how thick or thin they may be, employ a lid which is releasably retained in its closed position by a clasp, a catch or an equivalent mechanical mechanism (see, for instance, U.S. Pat. Nos. 1,682,534; 4,569,438 and 4,684,017). Magnets have also been employed in place of the more conventional clasps and catches (see, for instance, U.S. Pat. No. 3,317,078). While the magnetic locking mechanism disclosed in U.S. Pat. No. 3,317,078 may function effectively to retain the lid in its closed position, it is totally incapable of performing the dual function of sealing the joint between the lid and the base. Thus, the compact case of U.S. Pat. No. 3,317,078 requires the use of a separate sealing assembly, which is in the form of a tongue and groove. The need to provide a separate sealing assembly is disadvantageous because of the likely increase in manufacturing costs.

SUMMARY OF THE INVENTION

The problems and disadvantages of the prior art compact cases discussed above are overcome in accordance with the present invention by providing a compact case with a magnetic sealing mechanism which is adapted to positively seal a joint formed between a lid and a base of the case when the lid is in its closed position, in which it covers the base. In addition to such a sealing function, the magnetic sealing mechanism may function to releasably and/or moveably secure cosmetic product containers and/or cosmetic implements and accessories, such as mirrors, brushes and other applicators, to the compact case.

In one embodiment, the compact case is hingeless so that the lid is completely detached from the base when the compact case is open. When the compact case is closed, the lid is releasably locked in place over the base by magnetic force of sufficient magnitude to seal the joint formed between the lid and the base. The magnetic force can be generated by encasing very thin and flat permanent magnets of opposite polarity in the lid and the base, respectively. The magnet in the lid could also be used to releasably secure a mirror to the lid, assuming that the mirror is at least partially made out of a material which is attracted to the magnet. In a similar manner, the magnet in the base could be used to releasably secure cosmetic product containers, as well as brushes or other applicators and implements, to the base.

In another embodiment, the lid is pivotally attached to the base by a "living" hinge formed monolithically with the lid and the base so as to provide a compact case of unitary (i.e., one-piece) construction. This embodiment, like the hingeless embodiment, would utilize magnetic force to seal the joint formed between the lid and the base when the compact case is closed. The magnetic force could also be employed to releasably secure mirrors, brushes, applicators and other implements to the lid and/or the base.

BRIEF DESCRIPTION OF THE DRAWINGS

For a better understanding of the present invention, reference is made to following detailed description of various exemplary embodiments considered in conjunction with the accompanying drawings, in which.

DESCRIPTION OF THE EXEMPLARY EMBODIMENTS

Figure 1:
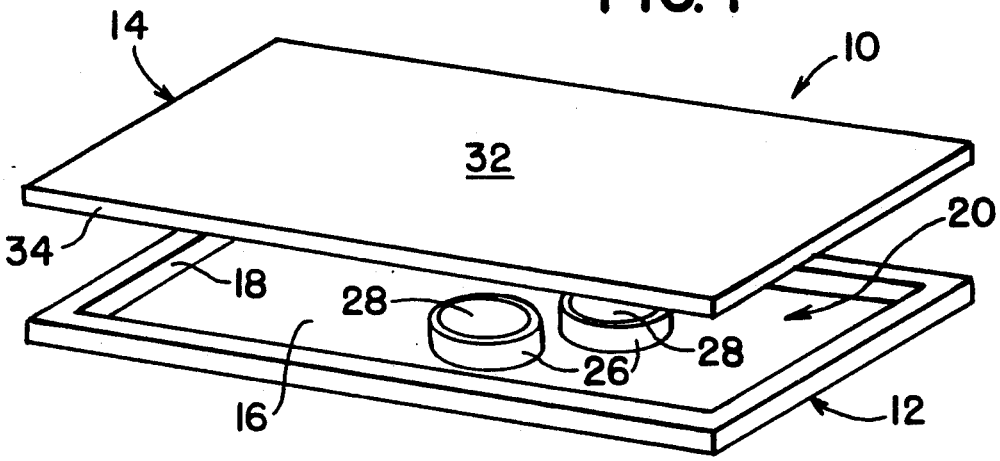
FIG. 1 is an exploded perspective view of a compact case constructed in accordance with one exemplary embodiment of the present invention, the compact case being shown in an open position.
Figure 2:
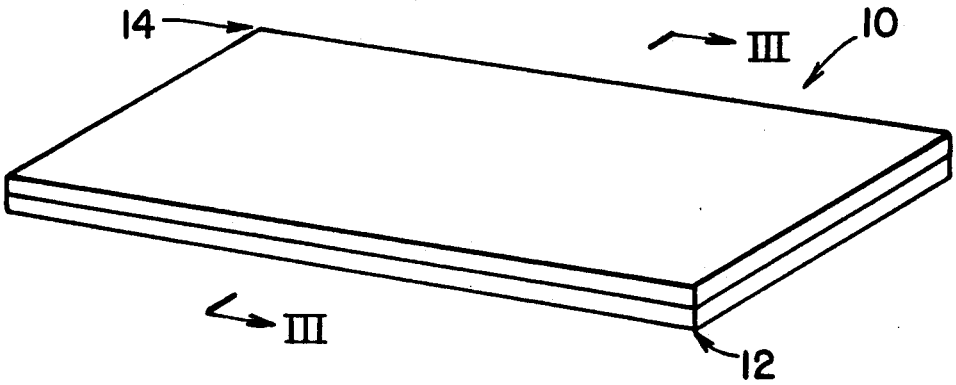
FIG. 2 is a perspective view of the compact case illustrated in FIG. 1, the compact case being shown in its closed position.
Figure 3:
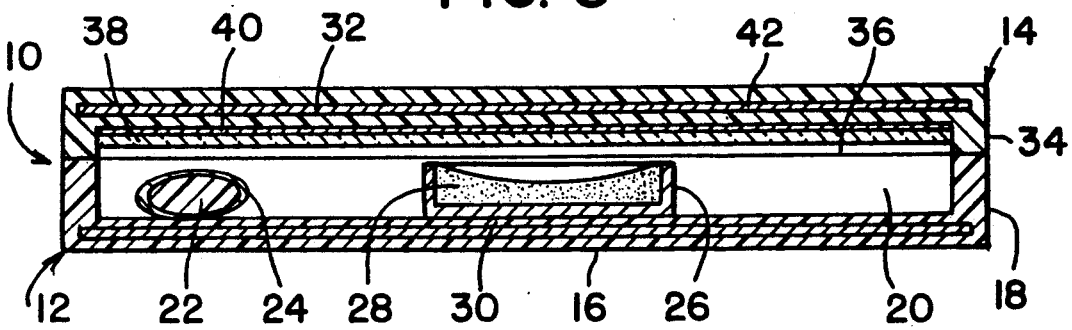
FIG. 3 is a cross-sectional view, taken along section III—III in FIG. 2 and looking in the direction of the arrows, of the compact case illustrated in FIG. 2.

Referring to FIGS. 1-3, a compact case 10 includes a base 12 and a lid 14, which is completely detachable from the base 12 so that the lid 14 can be moved between an open position (see FIG. 1) and a closed position (see FIG. 2). Thus, the compact case 10 is hingeless.

The base 12 includes a bottom wall 16 and a peripheral wall 18, which cooperates with the bottom wall 16 to define a recess 20. A brush 22, which has a metallic covering 24 for a purpose to be described hereinafter, is housed within the recess 20 of the base 12. The recess 20 also houses pans 26, each of which contains a powdered cosmetic product 28, such as eyeshadow or blush, or any other type of cosmetic product which is typically contained in a compact case. The pans 26 are made, at least partially, from a metallic material for a purpose which will be described hereinafter.

A permanent magnet 30 is encased within the bottom wall 16 of the base 12, which is preferably made from a relatively thin (i.e., in a range of from about 1/32 of an inch to about 1/16 of an inch) piece of thermoplastic material, such as polyvinylchloride, polyethylene, polypropylene or any suitable styrenic polymer. By making the base 12 from a relatively non-rigid thermoplastic material (e.g., polyvinylchloride) of such a nominal thickness, the base 12 can actually be flexible enough to bend into an arcuate shape. The elastic memory of the material would, of course, permit the base 12 to return to its normal substantially planar shape.

The magnet 30, which is substantially coextensive with the bottom wall 16 of the base 12, attracts the brush 22 and the pans 26 to thereby hold them in place against the bottom wall 16. However, the magnetic attraction is not so great as to prevent a user from moving the brush 22 and the pans 26 relative to the base 12 or from completely removing them from the base 12. Thus, the brush 22 can be repositioned within the base 12 or it can be removed completely and replaced with another cosmetic applicator or implement. In a similar manner, the pans 26 are removable to facilitate their replacement. The magnet 30 also serves another function which will be described hereinafter.

The lid 14 includes a top wall 32 and a peripheral wall 34, which cooperates with the top wall 32 to define a recess 36. A mirror 38, which has a metallic backing 40 for a purpose to be described hereinafter, is housed within the recess 36 of the lid 14.

A permanent magnet 42, having a polarity opposite from that of the magnet 30, is encased within the top wall 32 of the lid 14, which is preferably made from a relatively thin (i.e., in a range of from about 1/32 of an inch to about 1/16 of an inch) piece of thermoplastic material, such as polyvinylchloride, polyethylene, polypropylene or any suitable styrenic polymer. By making the lid 14 from a relatively non-rigid thermoplastic material (e.g., polyvinylchloride) of such a nominal thickness, the lid 14 can actually be flexible enough to bend into an arcuate shape and can cooperate with the base 12 to provide the compact case 10 itself with a substantially planar shape, at least when it is closed. The elastic memory of the material would, of course, permit the lid 14 to return to its normal substantially planar shape after it was bent out of such shape.

The magnet 42, which is substantially coextensive with the lid 14, attracts the mirror 38 to thereby hold it in place against the top wall 32 of the lid 14. However, the magnetic attraction is not so great as to prevent a user from removing the mirror 38 for replacement purposes or otherwise. If the mirror 38 is adhesively, rather than magnetically, attached to the lid 14, then a metallic plate could be used instead of the magnet 42.

The magnetic attraction between the magnet 42 and the magnet 30 is great enough to releasably lock the lid 14 in its closed position, in which the lid 14 covers the base 12 (see FIG. 2). The magnetic attraction between the magnet 30 and the magnet 42 is also great enough to force the peripheral wall 34 of the lid 14 into intimate contact with the peripheral wall 18 of the base 12, whereby substantially the entire joint formed by the interface between the peripheral wall 18 and the peripheral wall 34 is positively sealed to form what will preferably, but not necessarily, be an airtight or hermetic seal between the base 12 and the lid 14. The formation of such a seal inhibits the cosmetic in the pans 26 from sweating and/or spilling. If the cosmetic products are volatile (i.e., subject to evaporation), the formation of an airtight or hermetic seal would also inhibit their inadvertent evaporation.

Four other exemplary embodiments of compact cases constructed in accordance with the present invention are illustrated in FIGS. 4-9. Elements illustrated in FIGS. 4-9 which correspond to the elements described above with respect to FIGS. 1-3 have been designated by corresponding reference numerals increased by one hundred, two hundred, three hundred and four hundred, respectively. The embodiments of FIGS. 4-9 operate in the same manner as the embodiment of FIGS. 1-3 unless otherwise indicated.

Figure 4:
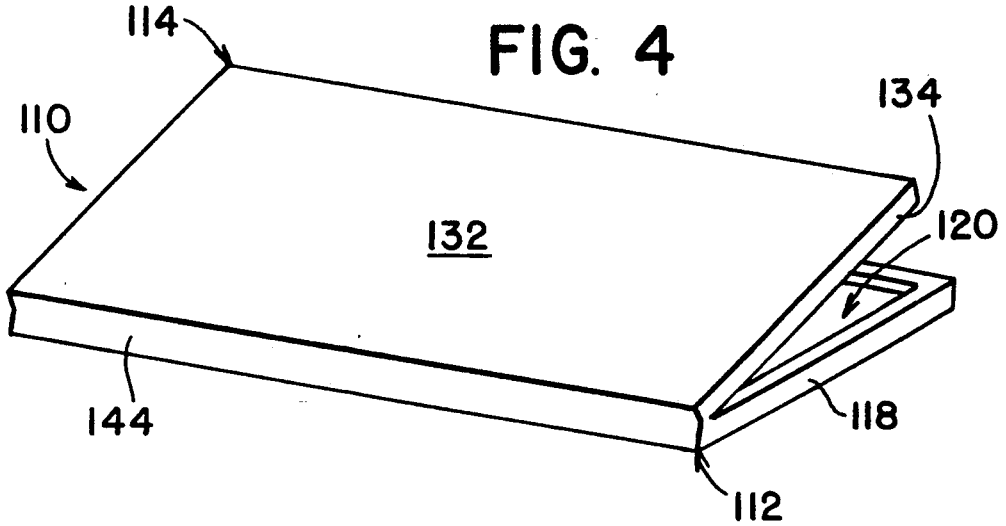
FIG. 4 is a perspective view of a compact case constructed in accordance with another exemplary embodiment of the present invention, the compact case being shown in a partially open position.
Figure 5:
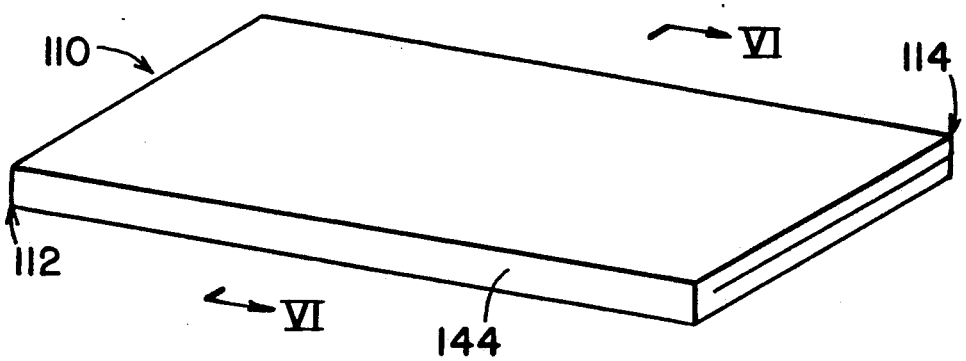
FIG. 5 is a perspective view of the compact case illustrated in FIG. 4, the compact case being shown in its closed position.
Figure 6:
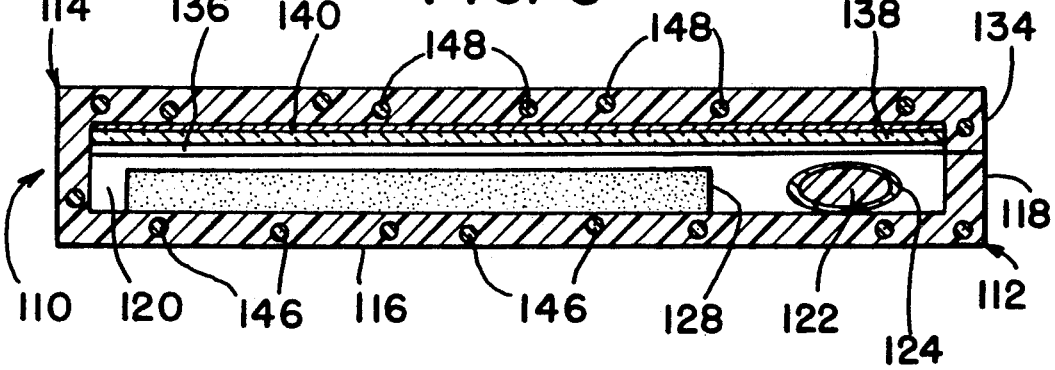
FIG. 6 is a cross-sectional view, taken along section line VI—VI in FIG. 5 and looking in the direction of the arrows, of the compact case illustrated in FIG. 5.

With reference to FIGS. 4-6, a compact case 110 includes a base 112 and a lid 114, which is hingedly attached to the base 112 by a "living" hinge 144 formed monolithically with the base 112 and the lid 114. Thus, the compact case 110 has a unitary (i.e., one-piece) construction. The hinge 144 permits the lid 114 to be opened (see FIG. 4) and closed (see FIG. 5) by a user of the compact case 110.

The base 112 includes a bottom wall 116 and a peripheral wall 118, which cooperates with the bottom wall 116 to define a recess 120. A brush 122, which has a metallic covering 124 for a purpose to be described hereinafter, is housed within the recess 120 of the base 112. The recess 120 also houses a quantity of a powdered cosmetic product 128, which is deposited as a thin film directly onto the bottom wall 116 of the base 112.

The base 112 is made from a thermoplastic material impregnated with magnetic particles 146, which were dispersed throughout the thermoplastic material prior to the molding of the base 112. In addition to releasably securing the brush 122 to the bottom wall 116 of the base 122, the magnetic particles 146 also serve another function which will be described hereinafter.

The lid 114 includes a top wall 132 and a peripheral wall 134, which cooperates with the top wall 132 to define a recess 136. A mirror 138, which has a metallic backing 140 for a purpose to be described hereinafter, is housed within the recess 136 of the lid 114.

The lid 114 is made from a thermoplastic material impregnated with magnetic particles 148, which have a polarity opposite from that of the magnetic particles 146. In addition to releasably securing the mirror 138 to the top wall 132 of the lid 114, the magnetic particles 148 also serve another function which will be described hereinafter.

The magnetic attraction between the particles 146 and the particles 148 is great enough to releasably lock the lid 114 in its closed position, in which the lid 114 covers the base 112 (see FIG. 5). The magnetic attraction between the particles 146 and the particles 148 is also great enough to force the peripheral wall 134 of the lid 114 into intimate contact with the peripheral wall 118 of the base 112, whereby substantially the entire joint formed by the interface between the peripheral wall 118 and the peripheral wall 134 is positively sealed to form what will preferably, but not necessarily, be an airtight or hermetic seal between the base 112 and the lid 114.

Figure 7:
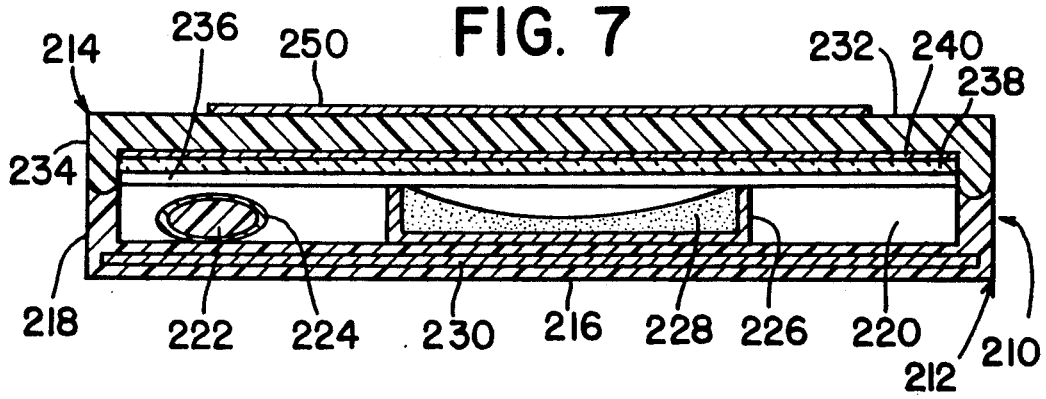
FIG. 7 is a cross-sectional view, which is similar to the cross-sectional view of FIG. 3, of a compact case constructed in accordance with a further embodiment of the present invention.

Referring now to FIG. 7, a compact case 210 includes a base 212 and a lid 214, which is completely detachable from the base 212. Thus, the compact case 210 is hingeless.

The base 212 includes a bottom wall 216 and a peripheral wall 218, which cooperates with the bottom wall 216 to define a recess 220. A brush 222, which has a metallic covering 224 for a purpose to be described hereinafter, is housed within the recess 220 of the base 212. The recess 220 of the base 212 also houses pans 226 (only one of which can be seen). Each of the pans 226 contains a powdered cosmetic product 228. The pans 226 are made, at least partially, from a metallic material for a purpose to be described hereinafter.

A permanent magnet 230 is encased within the bottom wall 216 of the base 212. In addition to releasably securing the brush 222 and the pans 226 to the bottom wall 216 of the base 212, the magnet 230 also serves another function which will be described hereinafter.

The lid 214 includes a top wall 232 and a peripheral wall 234, which cooperates with the top wall 232 to define a recess 236. A mirror 238, which has a metallic backing 240 for a purpose to be described hereinafter, is housed within the recess 236 of the lid 214.

A label 250 is mounted on the top wall 232 of the lid 214. The label 250 may contain indicia such as a product identification or trademark, advertising indicia, design, drawing or company logo. The label 250 is made out of a permanent magnet having a polarity opposite from that of the magnet 230. In addition to releasably securing the mirror 238 to the top wall 232 of the lid 214, the label 250 also serves another function which will be described hereinafter.

The magnetic attraction between the magnet 230 and the label 250 is great enough to releasably lock the lid 214 in a closed position, in which it covers the base 212. The magnetic attraction between the magnet 230 and the label 250 is also great enough to urge the peripheral wall 234 of the lid 214 into intimate contact with the peripheral wall 218 of the base 212, whereby substantially the entire joint formed by the interface between the peripheral wall 218 and the peripheral wall 234 is positively sealed to from what will preferably, but not necessarily, be an airtight or hermetic seal between the base 212 and the lid 214. In this regard, it is noted that the peripheral walls 218 234 have concave and convex shapes, respectively, so as to promote the formation of an airtight or hermetic seal between the base 212 and the lid 214 and to facilitate the proper registry and alignment of the base 212 and the lid 214.

In an alternate embodiment, the label 250 may be formed by applying a magnetic ink or similar liquid composition to the lid 214 of the compact case 210 by a rolling, coating or silk screening process. Magnetic inks are stable colloidal suspensions of ferromagnetic or ferromagnetic particles, such as $FeO_3$ in aqueous or organic bases. Liquid magnetic materials, including inks, have been produced by the powder-metallurgy process, using barium ferrite and other similar materials. Each ferrite particle is encapsulated in a single layer of molecules of a long-chain polymer. The capsules slide over each other with virtually no frictional resistance, so that when made as a suspension in water the liquid has the viscosity of water but the particles are so small that thermal agitation prevents them from steeling. Magnetic inks of the type disclosed in U.S. Pat. No. 4,944,802 (i.e., those containing ferromagnetic barium ferrite particles dispersed in a flexible polymer medium) may be used.

The label 250 of magnetic link would function the same as the label 250 made out of the permanent magnet discussed above. Thus, the magnetic ink of the label 250 functions to releasably secure the mirror 238 to the top wall 232 of the lid 214. Also, the magnetic attraction between the magnet 230 and the magnetic ink of the label 250 would be great enough to releasably lock the lid 214 in a closed position, in which it covers the base 212.

Figure 8:
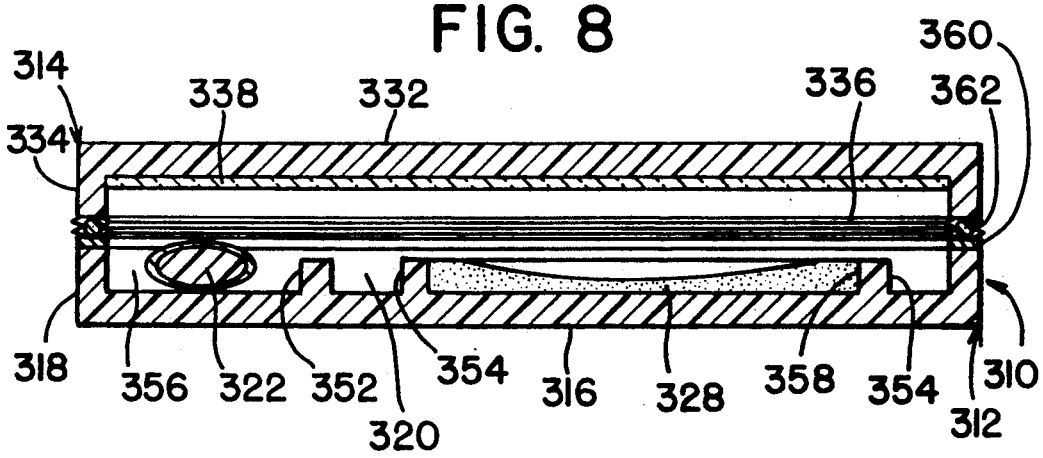
FIG. 8 is a cross-sectional view, which is similar to the cross-sectional view of FIG. 3, of a compact case constructed in accordance with yet another embodiment of the present invention.

With reference now to FIG. 8, a compact case 310 includes a base 312 and a lid 314, which is completely detachable from the base 312. Thus, the compact case 310 is hingeless.

The base 312 includes a bottom wall 316 and a peripheral wall 318 which cooperates with the bottom wall 316 to define a recess 320. Partitions 352, 354, which are formed monolithically with the bottom wall 316 of the base 312, divide the recess 320 into compartments 356 and 358, respectively. A brush 322 is loosely contained within the compartment 356, while powdered cosmetic product 328 is contained within the compartment 358.

A magnetic member 360, which can be a permanent magnet or a magnetic ink, is attached to the peripheral wall 318. The functions performed by the magnetic member 360, which has a shape that matches the contour of the peripheral wall 318, will be described hereinafter.

The lid 314 includes a top wall 332 and a peripheral wall 334, which cooperates with the top wall 332 to define a recess 336. A mirror 338 is housed within the recess 336 of the lid 314, the mirror 338 being permanently affixed by, for instance, an adhesive to the top wall 332 of the lid 314. Alternately, the mirror 338 could be provided with a metallic backing for releasably attaching the mirror 338 to the top wall 332 of the lid 314, if a logo or design is imprinted on the lid 314 using a magnetic ink or the like.

A magnetic gasket 362 is attached to the peripheral wall 334 of the lid 314. The magnetic gasket 362 has a shape which matches the contour of the peripheral wall 334 and a polarity which is opposite from that of the magnetic member 360. Although the magnetic gasket 362 is shown as a separate element in FIG. 8, it could also be formed monolithically with the lid 314 or the base 312 (i.e., as a natural extension thereof).

The magnetic attraction between the magnetic member 360 and the magnetic gasket 362 is great enough to releasably lock the lid 314 in a closed position, in which it covers the base 312. The magnetic attraction between the magnetic member 36 and the magnetic gasket 362 is also great enough to form an airtight or hermetic seal between the base 312 and the lid 314.

Figure 9:
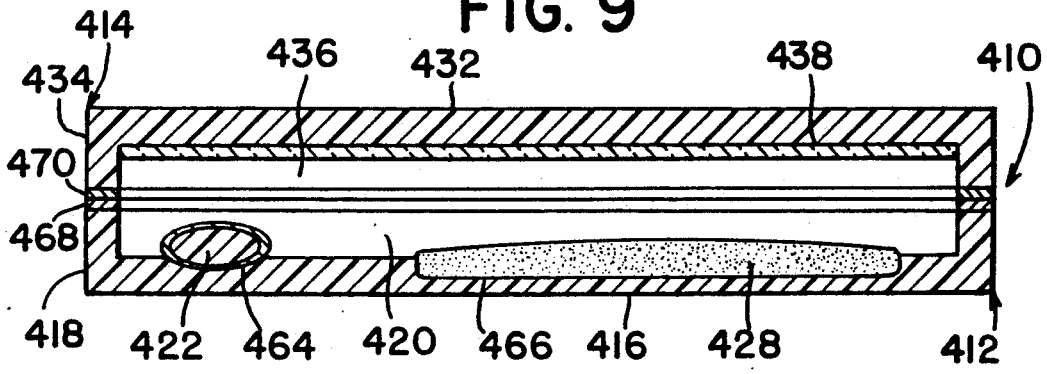
FIG. 9 is a cross-sectional view, which is similar to the cross-sectional view of FIG. 3, of a compact case constructed in accordance with a still further embodiment of the present invention.

Referring finally to FIG. 9, a compact case 410 includes a base 412 and a lid 414, which is completely detachable from the base 412. Thus, the compact case 410 is hingeless.

The base 412 includes a bottom wall 416 and a peripheral wall 418, which cooperates with the bottom wall 416 to define a recess 420. Depressions 464, 466 are provided in the bottom wall 416 by vacuum forming, pressing or any other suitable process. A brush 422 is loosely retained within the depression 464, while a powdered cosmetic product 428 is contained within the depression 466.

A magnetic member 468, which can be a permanent magnet or a magnetic ink, is attached to the peripheral wall 418 of the base 412. The function performed by the magnetic member 468, which has a shape that matches the contour of the peripheral wall 418, will be described hereinafter.

The lid 414 includes a top wall 432 and a peripheral wall 434, which cooperates with the top wall 432 to define a recess 436. A mirror 438 is housed in the recess 436 of the lid 414, the mirror 438 being permanently affixed by, for instance, an adhesive to the top wall 432 of the lid 414. Alternately, a metal-backed mirror 438 may be releasably attached to the top wall 432 of the lid 414, if a logo or design is imprinted on the lid 414 using a magnetic ink or the like.

A magnetic member 470, which can be a permanent magnet or a magnetic ink, is attached to the peripheral wall 434 of the lid 414. The magnetic member 470 has a shape which matches the contour of the peripheral wall 434 and has a polarity which is opposite from that of the magnetic member 468 for a purpose to be described hereinafter.

The magnetic attraction between the magnetic member 468 and the magnetic member 470 is great enough to releasably lock the lid 414 in a closed position, in which it covers the base 412. The magnetic attraction between the magnetic member 468 and the magnetic member 470 is also great enough to urge the magnetic members 468, 470 into intimate contact with each other, whereby substantially the entire joint formed by the interface between the peripheral wall 418 and the peripheral wall 434 is positively sealed to form what will preferably, but not necessarily, be an airtight or hermetic sea between the base 412 and the lid 414.

It will be understood that the embodiments described herein are merely exemplary and that a person skilled in the art may make many variations and modifications without departing from the spirit and scope of the invention. For instance, the magnetic elements employed by the present invention can be applied or affixed to the compact case by any suitable techniques, including but not limited to adhesively or otherwise attaching a magnetic strip or plate to the compact case. Also, the magnetic attraction between the lid and the base of the compact case can be created by applying magnetic ink or liquid to both the base and the lid. All such modifications and variations are intended to be included within the scope of the invention as defined in the appended claims.

I claim:

1. A claspless compact case comprising a substantially planar base having a peripheral edge; a substantially planar lid having a peripheral edge, said lid being movable relative to said base between an open position, in which said base is not covered by said lid, and a closed position, in which said peripheral edge of said lid is substantially adjacent to and substantially coextensive with said peripheral edge of said base, in which said base is covered by said lid such that said compact case is substantially planar and such that a joint is formed between said lid and said base, said joint extending along a peripheral edge of said substantially planar compact case; a first magnetic ink attached to and substantially coextensive with said peripheral edge of said base and substantially coextensive with said joint; and a second magnetic ink attache to and substantially coextensive with said peripheral edge of said lid, said second magnetic ink having a polarity which is opposite from that of said first magnetic ink, said second magnetic ink cooperating with said first magnetic ink to create a magnetic attraction between said base and said lid sufficient to releasably maintain said lid in its closed position and to positively seal said joint along substantially its entire length when said lid is in its said closed position, whereby said lid can be releasably maintained in its said closed position without the use of a clasp or latch.

2. A claspless compact case comprising a substantially planar base; a substantially planar lid, said lid being movable relative to said base between an open position, in which said base is not covered by said lid, and a closed position, in which said base is covered by said lid such that said compact case is substantially planar and such that a joint is formed between said lid and said base, said joint extending along a peripheral edge of said substantially planar compact case; first magnetic means which is a magnetic ink, integral with said base and substantially coextensive with said joint; and second magnetic means integral with said led and substantially coextensive with said joint, said second magnetic means cooperating with said first magnetic means to create a magnetic attraction between said base and said lid sufficient to releasably maintain said lid in its closed position and to positively seal said joint along substantially its entire length when said lid is in its said closed position, whereby said lid can be releasably maintained in its said closed portion without the use of a clasp or latch.

3. The compact case of claim 2 wherein said second magnetic means includes a magnetic ink which has a polarity opposite from that of said magnetic ink of said first magnetic means.

* * * * *